US005394655A

United States Patent [19]

Allen et al.

[11] Patent Number: 5,394,655

[45] Date of Patent: Mar. 7, 1995

[54] SEMICONDUCTOR POLISHING PAD

[75] Inventors: Franklin L. Allen, Sherman; William L. Smith, Howe; Thomas G. Debner, Howe; Dennis L. Olmstead, Sherman, all of Tex.

[73] Assignee: Texas Instruments Incorporated, Dallas, Tex.

[21] Appl. No.: 114,532

[22] Filed: Aug. 31, 1993

[51] Int. Cl.[6] ..... B24B 7/04

[52] U.S. Cl. ..... 451/63; 451/41; 451/548

[58] Field of Search ..... 51/209 R, 209 S, 209 DL, 51/210, 283 R, 119, 120, 131.3, 131.4, 132, 133, 281 SF, 131.1, 131.2, 131.5

[56] References Cited

U.S. PATENT DOCUMENTS

| | | | |
|---|---|---|---|
| 1,622,942 | 3/1927 | Chase | 51/209 S |
| 5,177,908 | 1/1993 | Tuttle | 51/209 R |
| 5,243,790 | 9/1993 | Gagne | 51/209 R |

*Primary Examiner*—Jack W. Lavinder
*Attorney, Agent, or Firm*—Warren L. Franz; Wade J. Brady III; Richard L. Donaldson

[57] ABSTRACT

The invention is to a polishing pad 14 that has a polishing surface 19 in which portions 17 and 18 of the polishing surface 19 have been removed. The removed areas 17 and 18 are annular rings adjacent an outer 15 and inner 16 edges of the polishing pad 14. The non-polishing surfaces 18 and 19 taper 17*a* and 18*a* downward from the polishing surface 19.

14 Claims, 2 Drawing Sheets

SEMICONDUCTOR POLISHING PAD

FIELD OF THE INVENTION

This invention relates to semiconductor materials, and more particularly to a polishing pad and method for polishing semiconductor wafers.

BACKGROUND OF THE INVENTION

The surfaces of wafers are polished to prepare them for the various processes during which devices are formed in the surface of the wafer. Polishing provides a smooth surface and removes irregularities that interfere with the various diffusion and masking processes utilized in making uniform devices across the surface of the wafer. Polishing is accomplished by mounting several semiconductor wafers in openings in a wafer holder and putting the wafers and holder between two polishing plates that have polishing pads thereon. The wafer holder is rotated and rolled around the periphery of the polishing machine to provide a planetary motion of the wafers during polishing. The movement of the wafer against the polishing pad is used in conjunction with an abrasive slurry of a fine particle size to provide the desired smoothness. One problem encountered with this process is that, although various controllable factors affecting polishing may be controlled, nonflat polishing occurs. Particularly, non-flatness occurs at the edge of the wafer, with the wafer edge receiving more polishing than the central portions, resulting in a "pillow-shaped" wafer. This provides an undesired tapering of the wafer from the center to the edges.

SUMMARY OF THE INVENTION

The invention provides an improved polishing pad and its method of use. The polishing pad has portions of the polishing surface removed by reducing the pad thickness, so that the parts of a wafer surface passing over the reduced thickness non-polishing portions of the pad are not polished as much as other parts of the wafer surface. The paths of the wafer surface contacting the polishing pad are predictable, therefore it is known which part of the wafer surface will receive minimum polishing. The parts of the pad surface removed are predetermined so that the polishing will not cause tapering of the wafer edges.

In an embodiment of the invention described below, an annular circular pad has two strips of the pad polishing surface removed by locally reducing the thickness of the pad, one strip adjacent the outer circumferential edge of the pad, and another strip adjacent the inner circumferential edge of the polishing pad. The motion of the wafers around the pad, and the rotation of the wafers in the wafer holder puts the edges of the wafers over the reduced portions of the pad more than the central portions of the wafers, are put over the same portion. This removes less surface of the outer edges of the wafer, thereby avoiding the non-flatness which occurs when the wafers are polished with pads not having the rings of the pad polishing surface removed. The reduced portions may be continuous rings, or segmented rings which add more strength to the polish pad than the continuous ring configuration. Edges of the removed strips are tapered to prevent tearing or binding on teeth of the wafer holder.

The technical advance represented by the invention, as well as the objects thereof, will become apparent from the following description of a preferred embodiment of the invention when considered in conjunction with the accompanying drawings, and the novel features set forth in the appended claims.

DESCRIPTION OF A PREFERRED EMBODIMENT

Figure 1:
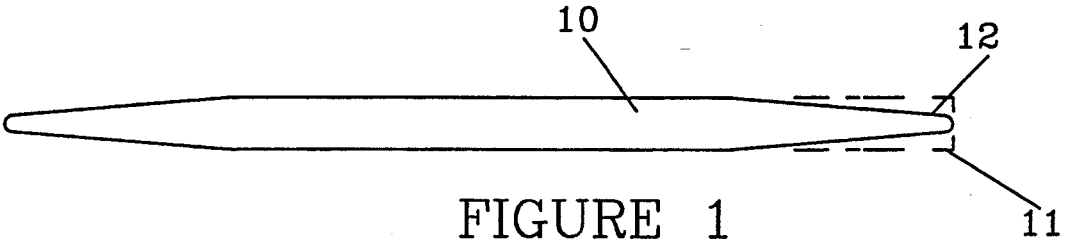
FIG. 1 shows the tapered wear on a semiconductor wafer.

FIG. 1 illustrates a semiconductor wafer 10 showing uneven wear or tapering at peripheral edge 12. If perfect polishing were accomplished, the surface of the wafer would be essentially flat to the edge as shown at 11.

Figure 2:
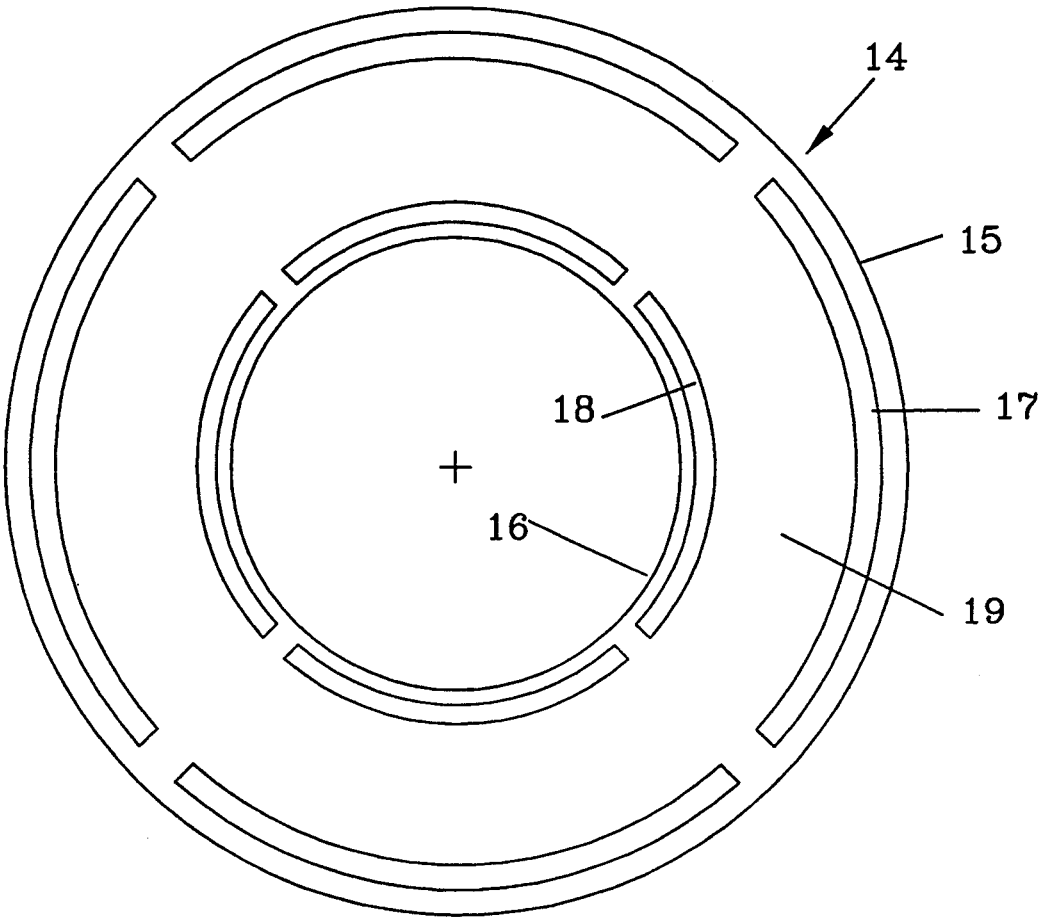
FIG. 2 shows one embodiment of a polishing pad of the present invention.

FIG. 2 shows an embodiment of the polishing pad according to the present invention. In this configuration, a flat planar pad 14, having a flat planar polishing surface 19, is in the form of an annular ring, having an outer circumferential edge 15 and an inner circumferential edge 16. The thickness of pad 14 is locally reduced to provide two rings 17 and 18 of removed polishing pad 14 surface on a central region of pad intermediate edges 15 and 16. The thickness reductions define non-polishing arcuate grooves or channels in the central region, arranged marginally of edges 15 and 16. In FIG. 2, non-polishing rings 17 and 18 are segmented to provide strength to the polishing pad. However, the use of a polishing pad of increased thickness would permit continuous non-polishing rings.

Figure 3:
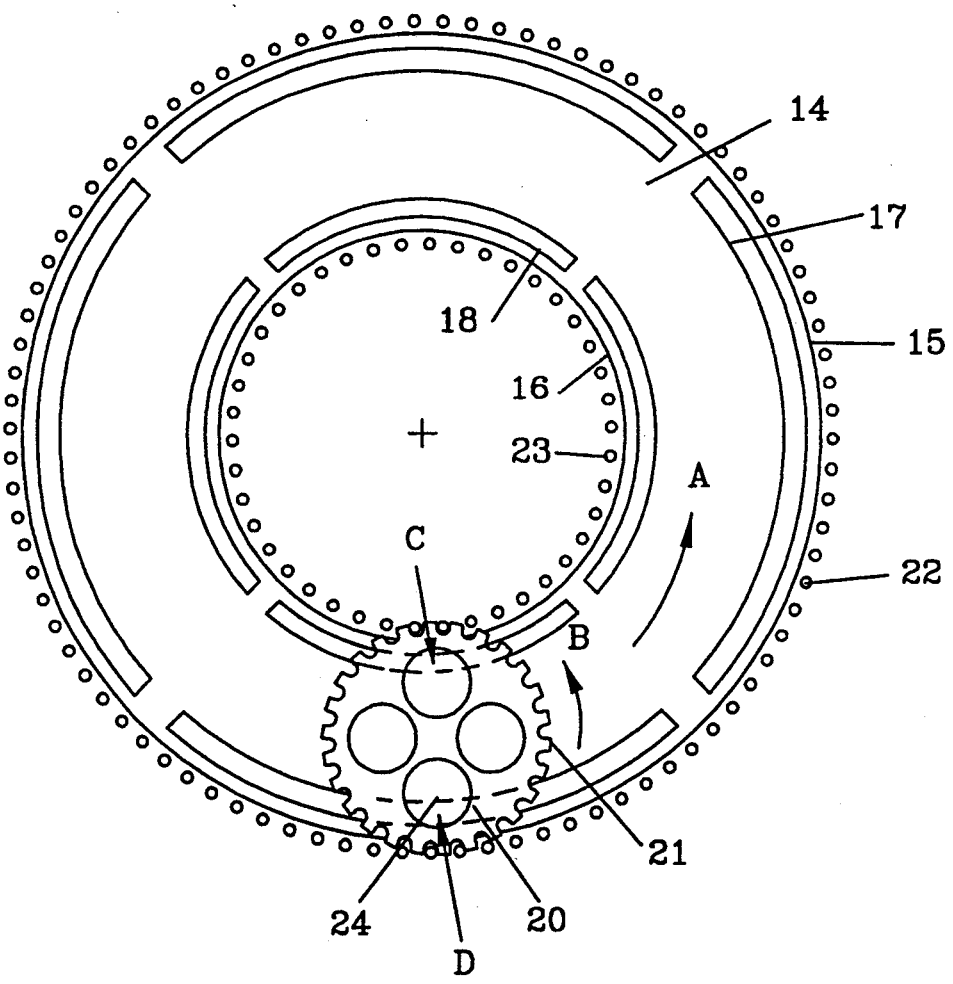
FIG. 3 is a top view of a wafer polisher with the top backing plate and top polishing pad removed.
Figure 4:
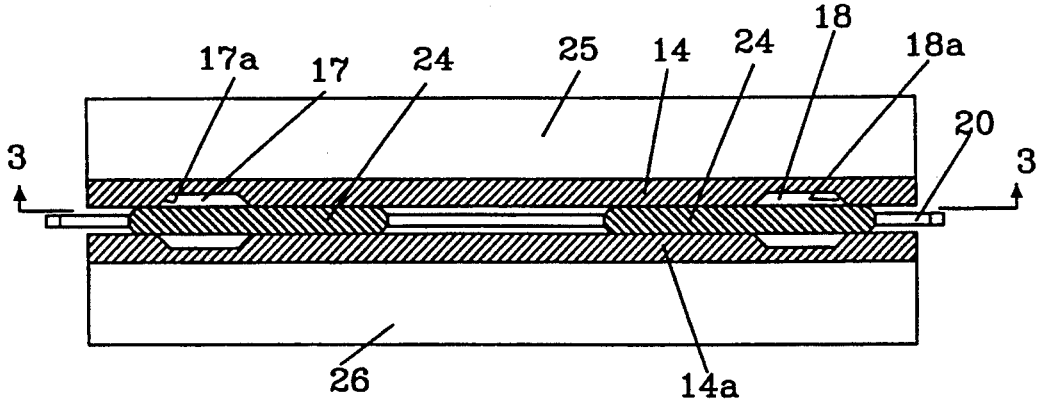
FIG. 4 is a cross-sectional view of a part of a wafer polisher when polishing.

FIG. 3 illustrates a top view of a polishing pad 14 in place in a partial view of a polishing machine. Pad 14 is on a polishing plate 26 (FIG. 4). On polishing pad 14 is a wafer holder 20 which, as illustrated, holds four wafers in openings 24. Wafer holder 20 has an outer circumference made up of external gear teeth 21. Gear teeth 21 are intermeshed with gear pins 22 and 23 on the polishing machine. When the polishing machine is in operation, the backing plate 25 and polishing pad 14 may rotate clockwise or counter clockwise as shown by arrow A. The rings of pins 22 and 23 rotate at different rotational velocities. These rotary motions cause wafer holder 20 to rotate as indicated by arrow B, and also move around the polishing machine in the direction indicated by Arrow A. In effect, the wafer is rotated on its own axis as it moves in a cycloidal motion around the polishing surface 19 on the polishing machine. As the wafer rotates, the edges of the wafer move over the non-polishing strips 17 and 18 as indicated at arrows C and D. During the process of polishing, the edges of the wafers traverse the non-polishing strips, limiting the polishing action at the wafer edges, therefore, not removing as much wafer surface at the edges of the wafer. This prevents the tapering or "pillowing" of the wafer edge, maintaining the wafer surface flat.

FIG. 4 shows a cross-sectional view of part of the polishing equipment. Wafer holder 20 is between lower polishing plate 26 and polish pad 14*a* and upper polish plate 25 and upper polish pad 14. Two wafers 20 are shown. Non-polishing strip 18 is shown with tapered edges 18*a* and non-polish strips 17 has tapered edges 17*a*. The purpose of the taper at the edge of the polish/-non-polish interface is to prevent edges that might tear or bind between the teeth of wafer holder 20 and pad 14.

It should be noted that reducing the thickness of the polishing pad at the non-polishing areas, rather than cutting all the way through the wafer, provides a shape which is more supportive of the wafer and wafer holder. The non-polishing areas are not necessarily circular segments, but may be any shape that will provide predictable selective polishing of the wafer surface.

An example using the polishing pad of the present invention has been made using an apparatus for polishing two sides of a semiconductor wafer, but a single side polishing machine may also provide the desired polishing using the polishing pad.

What is claimed:

1. A polishing pad for polishing a semiconductor wafer having a central portion and a circumferential edge, said pad comprising:

an annular ring member having an outer circumferential edge, an inner circumferential edge, and a central region of given thickness and having opposite sides located intermediate said outer and inner edges;

at least one of said sides defining a flat planar polishing surface which is unbroken except for first and second grooves in said polishing surface defining first and second localized reductions in said thickness respectively located marginally of said outer and inner edges;

said first and second reductions in thickness establishing non-polishing breaks in said polishing surface; and said breaks being dimensioned and configured so that the circumferential edge of a wafer moved cycloidally in fully supported position around said polishing surface will encounter said breaks more than the central portion of the wafer will encounter said-breaks.

2. A pad as defined in claim 1, wherein said first and second grooves have openings with edges tapered outwardly toward said openings.

3. A pad as defined in claim 1, wherein said first and second grooves are first and second arcuate grooves arranged in first and second rings respectively located marginally of said outer and inner edges.

4. A pad as defined in claim 1, wherein said first and second grooves are first and second pluralities of arcuate grooves arranged in first and second segmented rings respectively located marginally of said outer and inner edges.

5. A pad as defined in claim 4, wherein said first and second grooves have openings with edges tapered outwardly toward said openings.

6. In combination, a polishing machine and a polishing pad for polishing a semiconductor wafer having a central portion and a circumferential edge;

said polishing pad comprising an annular ring having an outer circumferential edge, an inner circumferential edge, and a central region of given thickness defining a flat planar polishing surface intermediate said outer and inner edges; said polishing surface being unbroken except for first and second grooves in said polishing surface defining first and second localized reductions in said thickness respectively located marginally of said outer and inner edges;

said first and second reductions establishing non-polishing breaks in said polishing surface; and said polishing machine comprising a wafer holder for mounting a wafer therein; and means for moving said wafer holder relative to said polishing pad to move the mounted wafer cycloidally in fully supported position around said polishing surface, so that the circumferential edge of the mounted wafer will encounter said breaks more than the central portion of the mounted wafer will encounter said breaks.

7. A combination as defined in claim 6, wherein said wafer holder has an outer circumference made up of gear teeth; and wherein said first and second grooves have edges tapered to prevent binding between said teeth and grooves.

8. A combination as defined in claim 6, wherein said first and second grooves are first and second pluralities of arcuate grooves arranged in first and second segmented rings respectively located marginally of said outer and inner edges.

9. A combination as defined in claim 8, wherein said wafer holder has an outer circumference made up of gear teeth; and said means for moving said wafer holder relative to said polishing pad comprises a first ring of pins in mesh with said gear teeth and located externally of said pad outer edge, a second ring of pins in mesh with said gear teeth and located internally of said pad inner edge, and means for rotating said second ring of pins relative to said first ring of pins.

10. A combination as defined in claim 9, wherein said grooves have openings, and edges tapered outwardly toward said openings.

11. A method for polishing a semiconductor wafer having a central portion and a circumferential edge, said method comprising the steps of:

providing a flat planar annular ring polishing pad having an outer circumferential edge, an inner circumferential edge and a central region having opposite sides located intermediate said outer and inner edges; one of said sides defining a polishing surface with first and second grooves respectively located marginally of said outer and inner edges; said grooves establishing non-polishing breaks in said polishing surface;

mounting a wafer on a wafer holder; and moving said wafer holder relative to said polishing pad to move the mounted wafer cycloidally around said polishing surface, so that the circumferential edge of the mounted wafer encounters said grooves more than the central portion of the wafer encounters said grooves.

12. A method as defined in claim 11, wherein said grooves are tapered grooves; said wafer holder has an outer circumference made up of gear teeth; and said moving step comprises rotating said wafer holder over said polishing surface using said gear teeth.

13. A method as defined in claim 12, wherein said grooves are first and second pluralities of arcuate grooves arranged in first and second segmented rings respectively located marginally of said outer and inner edges; and wherein said moving step comprises rotating said wafer holder about itself and about a center of said polishing pad by driving said gear teeth through interaction with relatively moving first and second rings of pins, respectively located externally of said pad outer edge and internally of said pad inner edge.

14. A method as defined in claim 11, for polishing a plurality of said wafers, and further comprising the steps of providing a second polishing pad like said first polishing pad; and mounting said first and second pads respectively on first and second plates; wherein, in said mounting step, said wafers are mounted in respective openings of said wafer holder and said wafer holder is placed between said polishing surfaces of said polishing pads mounted on said plates; and wherein, in said moving step, said mounted wafers are all moved cycloidally around said polishing surfaces, so that the circumferential edges of all mounted wafers encounter said grooves of both polishing surfaces more than the central portions encounter said grooves.

* * * * *